US006330902B1

(12) United States Patent
Chen

(10) Patent No.: US 6,330,902 B1
(45) Date of Patent: Dec. 18, 2001

(54) LENGTH ADJUSTABLE FOLDABLE DOOR ASSEMBLY

(76) Inventor: Chang Than Chen, 12 F, No. 426, Ming Chuan 2nd Road, Chien Chen Chu, Kaohsiung (TW)

( * ) Notice: Subject to any disclaimer, the term of this patent is extended or adjusted under 35 U.S.C. 154(b) by 32 days.

(21) Appl. No.: 09/629,138

(22) Filed: Jul. 31, 2000

(51) Int. Cl.[7] ..... E06B 3/48
(52) U.S. Cl. ..... 160/231.2; 160/199; 160/235
(58) Field of Search ..... 160/197, 199, 160/201, 206, 202, 203, 213, 231.2, 235; 49/505; 16/235, 239

(56) References Cited

U.S. PATENT DOCUMENTS

| | | | | |
|---|---|---|---|---|
| 2,770,298 | * | 11/1956 | Hiatt | 160/229.1 X |
| 2,978,020 | * | 4/1961 | Paulsrude | 160/229.1 X |
| 3,486,549 | * | 12/1969 | Rosenquist | 160/235 |
| 3,546,845 | * | 12/1970 | Kempel | 160/235 X |
| 3,862,523 | * | 1/1975 | Eaton | 160/231.2 X |
| 3,941,179 | * | 3/1976 | Root | 160/235 X |
| 3,972,365 | * | 8/1976 | Dixon | 160/183 |
| 3,994,330 | * | 11/1976 | Laby | 160/199 |
| 4,027,714 | * | 6/1977 | Dixon et al. | 160/231.2 X |
| 4,189,173 | * | 2/1980 | Rester | 292/86 |
| 4,332,287 | * | 6/1982 | Stolpe | 160/229.1 X |
| 4,455,708 | * | 6/1984 | Saigne | 16/56 |
| 5,065,808 | * | 11/1991 | Hopperdietzel | 160/231.2 |
| 5,148,850 | * | 9/1992 | Urbanick | 160/229.1 X |
| 5,822,810 | | 10/1998 | Chen | 4/610 |
| 5,918,659 | | 7/1999 | Lee | 160/199 |

* cited by examiner

*Primary Examiner*—Bruce A. Lev
(74) *Attorney, Agent, or Firm*—Charles E. Baxley

(57) ABSTRACT

A foldable door assembly includes a frame member and a jamb member, a latch slidably received in the jamb member and coupled to the jamb member with a spring member. An end beam is engageable into the frame member, and another end beam is coupled to the latch, and a number of door panels are coupled between the end beams. The spring member may resiliently and flexibly couple the latch and thus the other end beam to the jamb member for allowing the foldable door assembly to be adjusted to various lengths and to be attached to the door frames of different sizes or widths.

4 Claims, 3 Drawing Sheets

LENGTH ADJUSTABLE FOLDABLE DOOR ASSEMBLY

BACKGROUND OF THE INVENTION

1. Field of the Invention

The present invention relates to a foldable door assembly, and more particularly to a foldable door assembly having a length adjustable structure.

2. Description of the Prior Art

Typical foldable door assemblies comprise a number of door panels pivotally coupled together. One end of the door panels may be secured to one end of the door frame, and the other end of the door panels may be moved to be engaged into the other end of the door frame. U.S. Pat. No. 5,822,810 to Chen, the applicant of the present application, discloses one of the typical foldable door assemblies, in which the door panels may not be adjusted according to the different sizes of the door frames.

U.S. Pat. No. 5,918,659 to Lee discloses another typical foldable door assembly having a length adjustable structure for allowing the foldable door assembly to be attached to various kinds of door frames having different sizes or widths. However, one end of the door panels may not be secured in place and may be loosely slided relative to the door frame.

The present invention has arisen to mitigate and/or obviate the afore-described disadvantages of the conventional foldable door assemblies.

SUMMARY OF THE INVENTION

The primary objective of the present invention is to provide a foldable door assembly including a spring biasing device for resiliently and stably coupling one end of the door panels to the door frame.

In accordance with one aspect of the invention, there is provided a foldable door assembly comprising a first frame member including a chamber formed therein, a jamb member including a chamber formed therein, a first latch slidably received in the chamber of the jamb member, a spring member coupled between the first latch and the jamb member for limiting a movement of the first latch relative to the jamb member, and a foldable door device including a first end beam for engaging into the chamber of the first frame member, a second end beam coupled to the first latch, and at least one door panel coupled between the first end beam and the second end beam. The spring member may resiliently and flexibly couple the latch and thus the second end beam to the jamb member for allowing the foldable door assembly to be adjusted to various lengths and to be attached to the door frames of different sizes or widths.

The second end beam includes a channel formed therein, the first latch is engaged in the channel of the second end beam for coupling the second end beam to the jamb member, the spring member limits the movement of the first latch and the second end beam relative to the jamb member.

The door panel and the first end beam each includes a first end having a channel formed therein, the second end beam includes a first end, the door panel and the second end beam each includes a second end having a second latch provided thereon and engaged in the channels of the door panel and the first end beam respectively for coupling the door panel and the first end beam and the second end beam together.

The second end of the door panel and the second end beam each includes a flexible link provided thereon and coupled to the second latch for flexibly coupling the door panel and the first end beam and the second end beam together.

The first frame member includes a pair of inwardly extended flanges extended inward of the chamber thereof for engaging with and for retaining the first end beam of the foldable door device to the first frame member.

A second frame member is further provided and includes a first hook device provided thereon, and the jamb member includes a second hook device engaged with the first hook device for securing the jamb member to the second frame member.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
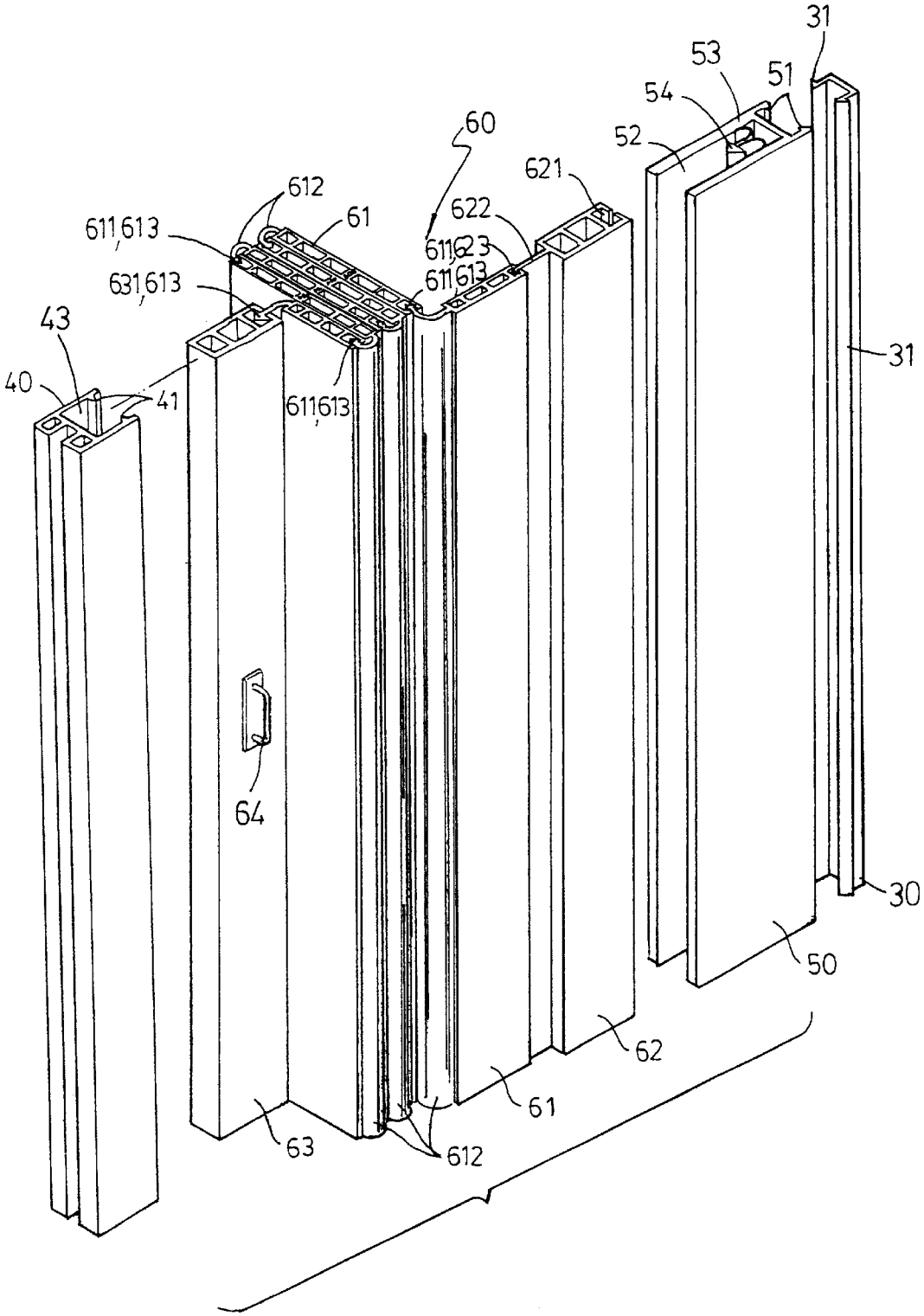
FIG. 1 is an exploded view of a foldable door assembly in accordance with the present invention.
Figure 2:
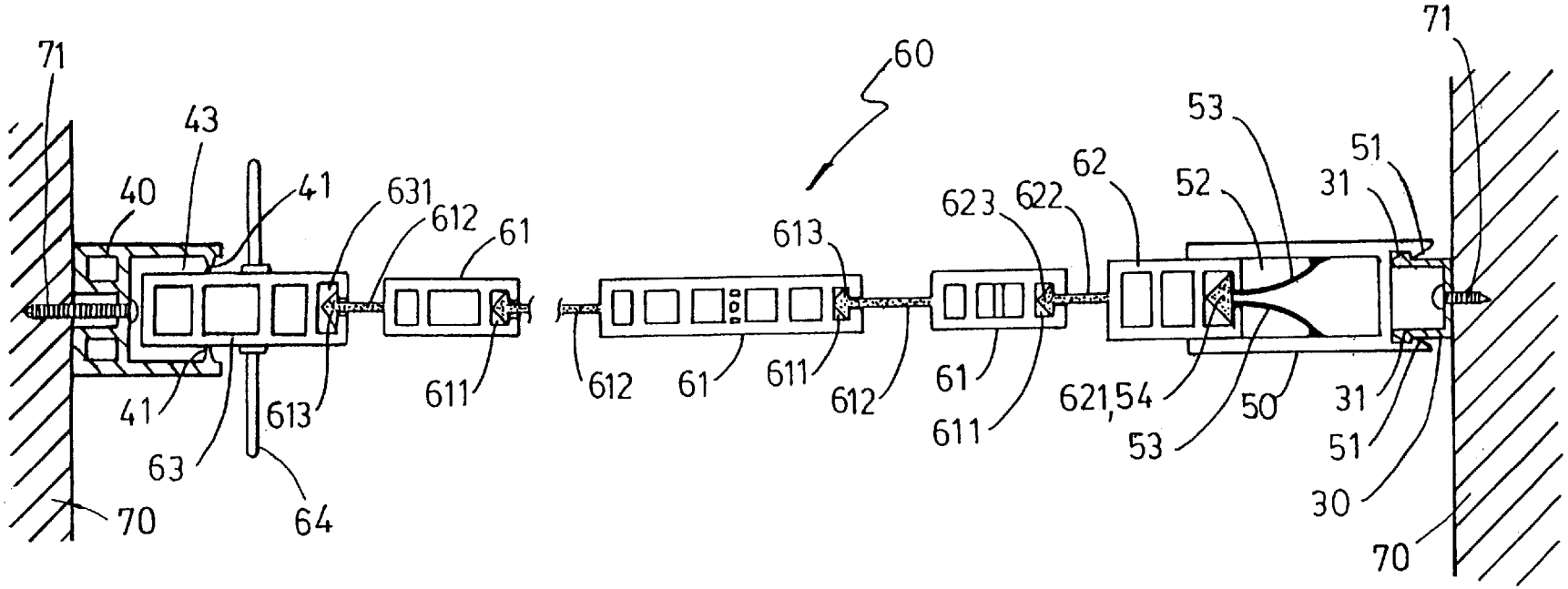
FIG. 2 is a partial top view of the foldable door assembly.
Figure 3:
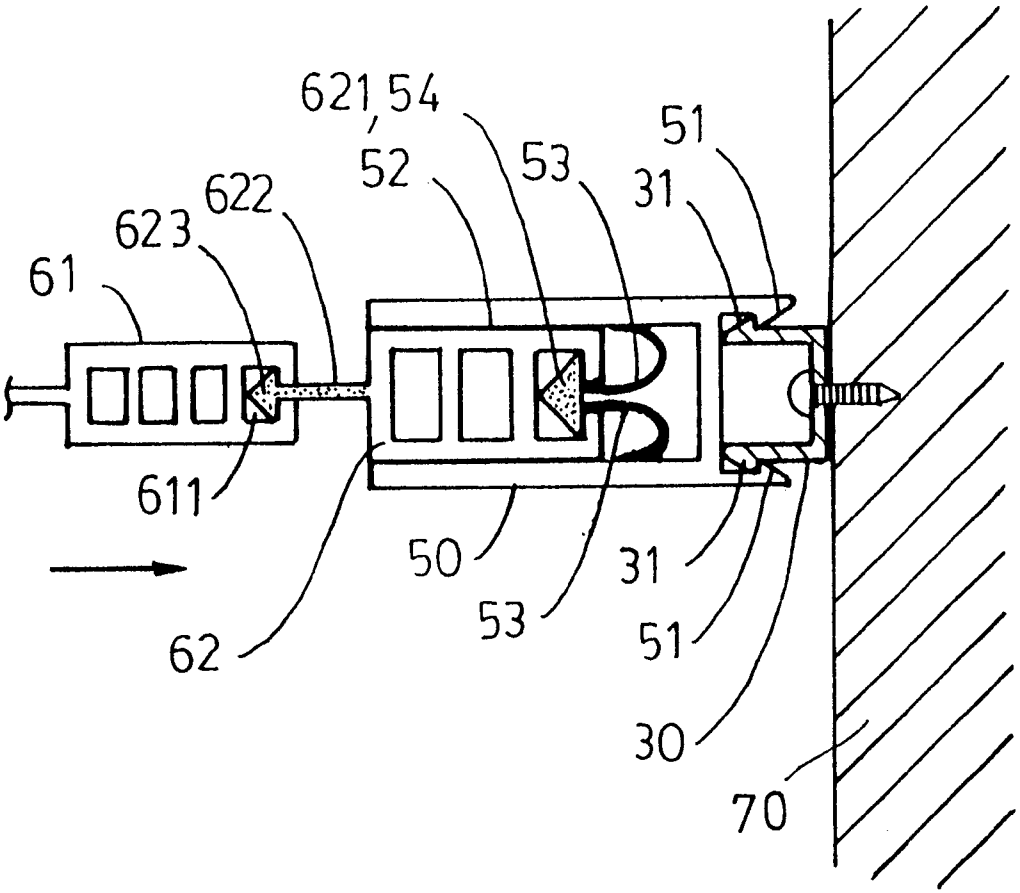
FIG. 3 is a partial top view illustrating the operation of the foldable door assembly.

Referring to the drawings, and initially to FIGS. 1 and 2, a foldable door assembly in accordance with the present invention comprises a pair of frame members 30, 40 oppositely secured to the support member 70, such as the wall or to the door frame, by such as the fasteners 71. The frame member 30 includes a hook device 31, such as a pair of outwardly extended hooks 31, provided thereon. The frame member 40 includes a pair of inwardly extended flanges 41 extended inward of a chamber 43 thereof and preferably made of resilient or rubber material for resiliently clamping purposes. A jamb member 50 includes a hook device 51, such as a pair of inwardly extended hooks 51, provided thereon, for engaging with the hooks 31 of the frame member 30 and for securing the jamb member 50 to the frame member 30. The jamb member 50 includes a chamber 52 formed therein and facing away from the frame member 30, and includes a spring-biasing device 53, such as a pair of spring members 53 provided therein, and includes a latch 54 secured to the free end(s) of the spring members 53, such that the latch 54 may be moved along the chamber 52 of the jamb member 50 and may be recovery by the spring members 53. The jamb member 50 may be formed or made from plastic material and may be made or formed by an extruded process with an extruding machine. The frame members 30, 40 may also be manufactured by the extruding processes. The spring members 53 may be simultaneously formed in the jamb member 50 from such as a rubber material, with the extruding machine or with the other extruding machine, when the jamb member 50 is formed by the extruded processes. The latch 54 is preferably made of the plastic material similar to that of the jamb member 50, and may also be formed integral with the spring members 53 by the extruding process with the extruding machine. The spring members 53 may also be made of the other materials, such as the metal spring members or the like.

A foldable door device 60 includes a number of door panels 61 and two end beams 62, 63 each having a channel 611, 621, 631 formed in one end thereof and each having a resilient or flexible link 612, 622 and a latch 613, 623 provided on the other end thereof, except the end beam 63. The door panels 61 and the beams 62, 63 may be formed or made from plastic material and may be made or formed by the extruded process with the extruding machine. The resilient or flexible link 612, 622 may be simultaneously formed and coupled to the door panels 61 and the beam 62 from such as the rubber material, with the extruding machine or with the other extruding machine, when the door panels 61 and the beam 62 are formed by the extruded processes. The latches 613, 623 are preferably made of the plastic material similar to that of the door panels 61 and the beams 62, and may also be formed integral with the flexible link members 612, 622 by the extruding process with the extruding machine. The flexible links 612, 622 may also be made of the other materials, such as the metal spring members or the like. The latches 54, 613, 623 of the jamb member 50 and of the door panels 61 and of the beam 62 may be detachably engaged or secured to the respective channels 621, 611, 631 of the beam 62 and of the door panels 61 and of the other beam 63 respectively, for resiliently and foldably coupling the door panels 61 and the beams 62, 63 and the jamb member 50 together.

Referring again to FIGS. 1 and 2, the frame members 30, 40 are secured to the support wall 70. The jamb member 50 may be secured to the frame member 30 with the hook devices 31, 51. The latch 54 of the jamb member 50 may be detachably engaged into the channel 621 of the end beam 62. The latch 623 of the end beam 62 may be engaged into the channel 611 of one of the door panels 61. The latches 613 of the door panels 61 may be engaged into the channel 611 of the other door panels 61 for coupling the door panels 61 together. The latch 613 of the other end door panel 61 may be engaged into the channel 631 of the other end beam 63. The end beam 63 includes a handle 64 provided thereon for moving the end beam 63 to engage into the frame member 40. The end beam 63 may be retained or secured to the frame member 40 by the resiliently clamping force of the inwardly extended flanges 41 of the frame member 40 when the door panels 61 are extended or stretched to the working position as shown in FIG. 2. The handle 64 may move the end beam 63 away from the frame member 40 and the door panels 61 may be folded to the compact folding or storing position. The links 622, 612 are flexible and foldable for allowing the door panels 61 to be folded relative to each other and to be rotatable relative to the beams 62, 63.

In operation, as shown in FIG. 2, the spring member(s) 53 may be extended or folded or stretched for resiliently coupling the beam 62 to the jamb member 50 and for allowing the beam 62 to be slidably retained within the chamber 52 of the jamb member 50 and for preventing the beam 62 from being disengaged from the jamb member 50. The beam 62 may thus be limited to move relative to the jamb member 50. The foldable door device 60 may thus be attached to the door frames of various sizes or widths. Particularly, when the end beam 63 of the foldable door device 60 is engaged into the frame member 40, the spring members 53 are preferably stretched or extended for allowing the door panels 61 to be aligned in line. When the end beam 63 is disengaged from the frame member 40, the spring member(s) 53 preferably may pull the beam 62 inward of the jamb member 50 for recovering the beam 62 and the foldable door device 60.

Accordingly, the foldable door assembly in accordance with the present invention includes a spring biasing device for resiliently and stably coupling one end of the door panels to the door frame.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A foldable door assembly comprising:

a) a first member including a chamber formed therein;

b) a second member slidably engaged in said chamber of said first member, and including a channel formed therein;

c) a latch received in said chamber of said first member for engaging into said channel of said second member and for resiliently coupling said second member to said first member; and d) at least one spring member formed integral between said latch and said first member for limiting a movement of said latch relative to said first member.

2. The foldable door assembly according to claim 1 further comprising:

a frame member including a chamber formed therein, and a foldable door device including an end beam slidably engaged in said chamber of said frame member, and at least one door panel coupled between said end beam and said second member.

3. The foldable door assembly according to claim 2, wherein said end beam includes a first end having a channel formed therein, said at least one door panel includes a first end having a flexible link extended therefrom and having a latch provided on said flexible link and engaged into said channel of said end beam for flexibly coupling said at least one door panel to said end beam.

4. The foldable door assembly according to claim 2, wherein said at least one door panel includes a first end having a channel formed therein, said second member includes a first end having said channel formed therein, and includes a second end having a flexible link extended therefrom and having a latch provided on said flexible link and engaged into said channel of said second member for flexibly coupling said at least one door panel to said second member.

* * * * *